United States Patent [19]

Takahashi et al.

[11] Patent Number: 4,926,015

[45] Date of Patent: May 15, 1990

[54] LIQUID LEVEL SENSOR HAVING A RETAINED BASE PLATE

[75] Inventors: Toshinori Takahashi; Chikahisa Hayashi; Yoshinori Takahashi; Takanori Kantoh, all of Aichi, Japan

[73] Assignee: Toyoda Gosei Co., Ltd., Nishikasugai, Japan

[21] Appl. No.: 209,905

[22] Filed: Jun. 22, 1988

[30] Foreign Application Priority Data

Jun. 22, 1987 [JP] Japan ..... 62-95688
Jun. 29, 1987 [JP] Japan ..... 62-100139

[51] Int. Cl.[5] ..... H01H 35/18

[52] U.S. Cl. ..... 200/84 C; 73/313; 340/624; 361/395

[58] Field of Search ..... 340/623, 624, 52 C, 340/59; 73/307, 308, 313; 307/118; 200/84 C, 84 R, 61.2; 361/331, 380, 395, 399, 398, 397

[56] References Cited

U.S. PATENT DOCUMENTS 3,826,139 7/1974 Bachman ..... 73/313
3,976,963 8/1976 Kubler ..... 200/84 C
4,020,481 4/1977 Nakagawa .
4,227,236 10/1980 Kubler ..... 200/84 C
4,356,729 11/1982 Kubota et al. ..... 200/84 C

FOREIGN PATENT DOCUMENTS 56-42462 4/1981 Japan .
2078010 6/1981 United Kingdom ..... 200/84 C

*Primary Examiner*—Gerald P. Tolin
*Attorney, Agent, or Firm*—Cushman, Darby & Cushman

[57] ABSTRACT

The liquid level sensor comprising a tubular case with an inner surface, a base plate having a wiring and disposed in the case so as to extend lengthwise of the case is disclosed. A switch member is disposed on the base plate and is electrically connected with the wiring. A float is disposed outside of the case and is movable in accordance with a displacement of the liquid surface of the liquid in the reservoir tank. A driving member is disposed on the float so as to drive the switch member. A retaining member is disposed on at least one of the inner surface of the case and the base plate so as to support and secure the base plate in the case.

17 Claims, 12 Drawing Sheets

LIQUID LEVEL SENSOR HAVING A RETAINED BASE PLATE

FIELD OF THE INVENTION

The present invention relates to a liquid level sensor which detects the displacement of a level of liquid stored in various kinds of containers.

DESCRIPTION OF THE RELATED ART

A container for a vehicle storing brake oil or power steering oil is provided with a liquid level sensor so that the displacement of the liquid level can be detected and identified by a driver. The liquid level sensor is provided, as shown in FIGS. 21 and 22, with a tubular case main body 433 on which a base plate 432 having a reed sWitch 431 is disposed and a float 435 outwardly fitted freely on the tubular case main body 433 and floating on a liquid surface. A magnet 434 is attached to the float 435 and a reed switch 431 is actuated by the magnet 434 when the liquid decreases and the liquid surface lowers to a prescribed level.

The reed switch 431, however, occupies a rather big space in the tubular case main body 433, therefore the size of the base plate 432 is limited and it is not secured to the tubular case main body 435. PV this reason, the base plate 432 vibrates at its own frequency in the tubular case main body 433 due to vibration and shock while driving a vehicle. Accordingly, the reed sWitch 431 may operate erroneously or strike against an inner surface 433*a* of the tubular case main body 433 resulting in damage to the reed switch.

In order to cope With the problem mentioned above, Japanese Utility Model Laid Open No. 56-42462 discloses a liquid level sensor wherein a reed switch together with a base plate is wound with a sponge-like elastic material and wherein the reed switch and base plate are disposed in a tubular case main body. In such a liquid level sensor, vehicle vibration and shock can be alleviated bY the sponge-like elastic material and erroneous operation or damage of the reed switch can be prevented.

However, in the latter sensor, it is troublesome to wind the sponge-like elastic material around the base plate and insert the sponge like elastic material in a compressed state into the tubular case main body and there is a problem in assembling work. Further, there is a problem that the number of parts constituting the liquid level sensor increases due to the provision of the sponge-like elastic material, causing a higher production cost.

In a liquid level sensor shown in FIG. 23, a lead wire 538 connected to a, switch member 537 is led, out from a case main body 535. To the extreme end of the lead wire 538 a connector 539 having a connecting terminal is electrically connected. A connector 540 originating from the vehicle body is connectable with the connector 539.

However, in the liquid level sensor mentioned above, the connecting terminal at the extreme end of the lead wire 538 led out from an opening portion 535*a* of the case main body 535 is not secured to the case main body 535. Accordingly, in the installation of the liquid level sensor on the vehicle, it is necessary to hold the connectors 539 and 540 with both hands in order to connect the connector 540 with the connector 539 and there is a problem in that the connection work is hard to be done. Further, in this connection work, the connector 539 may is pulled so hard that an excessive force be put on the lead wire 538, causing the same to be damaged. In this case, the whole of the liquid level sensor has to be replaced.

SUMMARY OF THE INVENTION

The object of the present invention is to provide a liquid level sensor Which can prevent a switch member from making erroneous operation or from being damaged by holding down a vibration of a base plate in a case main body caused from a vibration or shock imposed from outside, without complicated assembly work nor increase in the number of parts required.

Another object of the present invention is to provide a liquid level sensor which does not require the connecting terminal of a switch member to be held by hand in case of connecting the same With a connector. According to the present invention, the connecting work of a connector can be carried out easily and securely thereby enabling an improvement of the working efficiencY.

A further object of the present invention is to provide a liquid level sensor enabling a case main body to be a small size.

A still further object of the present invention is to provide a liquid level sensor requiring no lead wire for a switch member and preventing a lead wire from being damaged in the connecting work.

In order to accomplish the above mentioned objects, the present invention comprises a tubular case main body having an inner surface; a base plate disposed in the case main body, extending in a longitudinal direction thereof and having a wiring; a switch member provided on the base plate and connected electrically with the wiring; a float disposed outside of the case main body and movable according to a displacement of a liquid surface of a liquid reservoir tank; a driving member provided on the float and driving the switch member; and a retaining member provided on either one of the inner surface of the case main body and the base plate and supporting and securing the base plate within the case main body.

The other objects of the present invention will become clear from the understanding of preferred embodiments thereof described below and clearly stated in the appended claims. Many other advantages Which are not mentioned in this specification will occur to those skilled in the art when carrying out the present invention.

BRIEF DESCRIPTION OF THE DRAWINGS

FIG. 1 is a partially vertical sectional view of the liquid level sensor attached to the reservoir tank.

FIG. 2 is an exploded perspective vieW of the liquid level sensor.

FIG. 3 is a sectional view taken along the line III—III of FIG. 1.

FIG. 4 is a sectional view taken along the line IV—IV of FIG. 3.

FIG. 11 is a partially exploded perspective view of a liquid level sensor.

FIG. 12 is a partially vertical sectional view showing a state of the liquid level sensor attached to a reservoir tank.

FIG. 14 is a partially vertical sectional view showing a liquid level sensor attached to a reservoir tank.

FIG. 15 is a partially exploded perspective view of the liquid level sensor.

FIG. 16 is a sectional view taken along the line XVI—XVI of FIG. 14.

FIG. 17 is a partially sectional view showing an attached state of a reed switch.

FIG. 18 is a front view showing a printed plate.

DETAILED DESCRIPTION OF THE PREFERRED EMBODIMENTS

(First Embodiment)

A first embodiment of the present invention in which the invention is embodied in a liquid level sensor of a brake oil reservoir tank for a vehicle will be described hereinunder with reference to FIGS. 1 to 4

Figure 1:
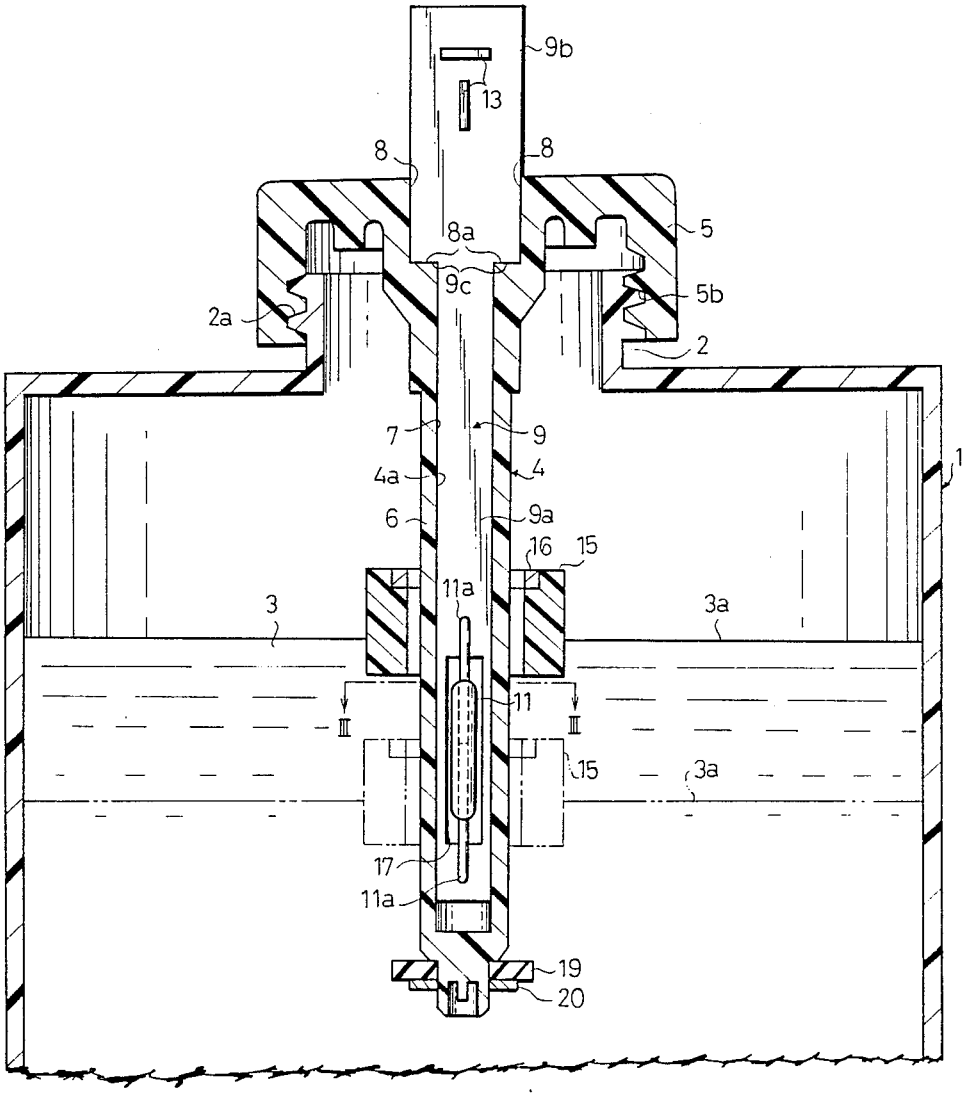
FIGS. 1 to 4 show a first embodiment embodying a liquid level sensor attached to a reservoir tank for brake oil.
Figure 2:
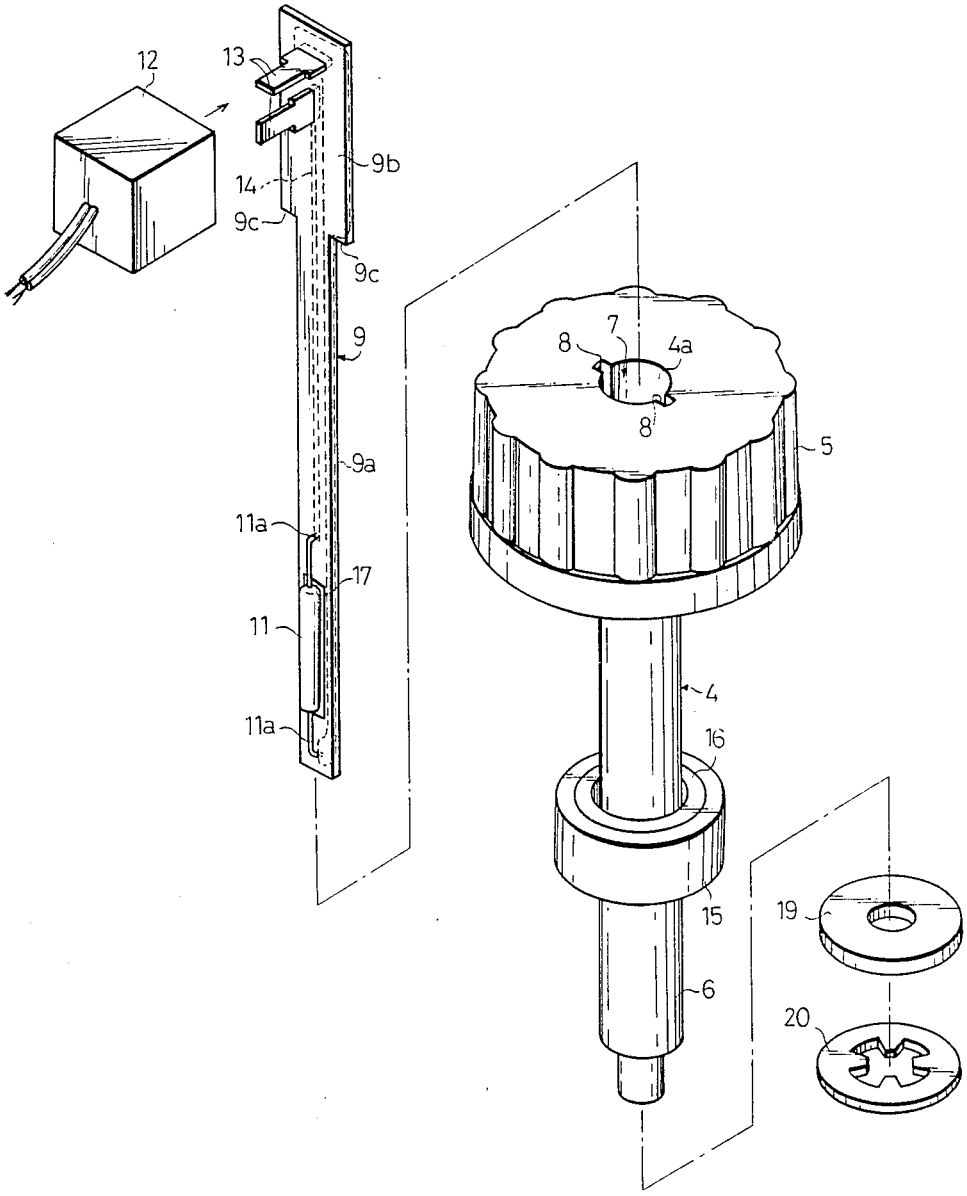

As shown in FIGS. 1 and 2, a cYlindrical sensor mounting portion 2 with an opening at the upper end is disposed projectingly at substantially the central portion of the upper surface of a reservoir tank 1 wherein brake oil 3 is stored. On the outer periphery of the sensor mounting portion 2, a male thread 2*a* is formed, on which a liquid level sensor is fitted.

Referring to the liquid level sensor, a tubular case 4 comprises a cover member 5 provided inside thereof with a female thread 6*b* engageable with the male thread 2*a* of the sensor mounting portion 2 and a tubular member 6 extending from the central portion of a lower surface of the cover member 8 toward the lower part of the reservoir tank 1. The tubular case 4 is bored with a fitting hole 7 having a circular plate and extending from an upper surface of the cover member to the lower end of the tubular member 6, where the fitting hole 7 is closed.

On symmetrical positions of the upper part of the inner surface 4*a* of the tubular case 4 defined by the fitting hole 7, a pair of keyways 8 as a receiving portion are formed extending downward of the cover member 5.

Figure 3:
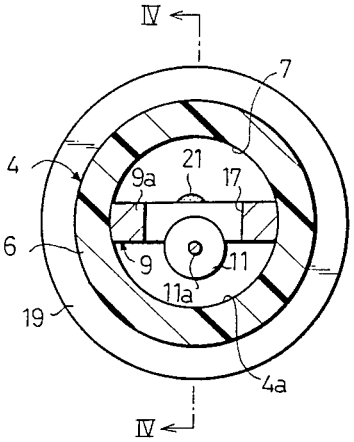

In the fitting hole 7 and keyways 8, a printed board 9 is inserted as a base plate. The printed board 9 comprises a detective portion 9*a* which is inserted in the fitting hole 7 and detects a displacement of liquid surface 3*a* of the brake oil 3 and a connecting portion 9*b* which is formed integrally with the detective portion 9*a* on its upper part through a stepped portion 9*c*. The connecting portion 9*b* engages with the keyways 8 and connects with a connector mentioned later. As shown in FIG. 3, a width of the detective portion 9*a* is the same with a diameter of the fitting hole 7. Both sides of the detective portion 9*a* abut against the inner surface 4*a* of the tubular case and define a retaining means to support and fix the printed board 9 in a widthwise direction thereof. Also, the keyways 8 define a second retaining means to support and fix the connecting portion 9*b* of the printed board 9.

Further, as shown in FIG. 1, the stepped portion 9*c* is adapted to engage with a stepped portion 8*a* formed as an engaging portion at the lower ends of the keyways 8. Accordingly, the printed board is inserted into the tubular case 4 and the stepped portions 9*c* of the printed board 9 abut against the stepped portions 8*a* of the keyways 8, whereby the printed board 9 has its position determined relative to the tubular case 4.

Figure 4:
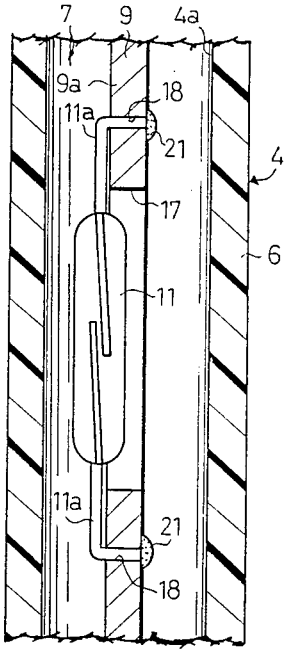
Figure 8:
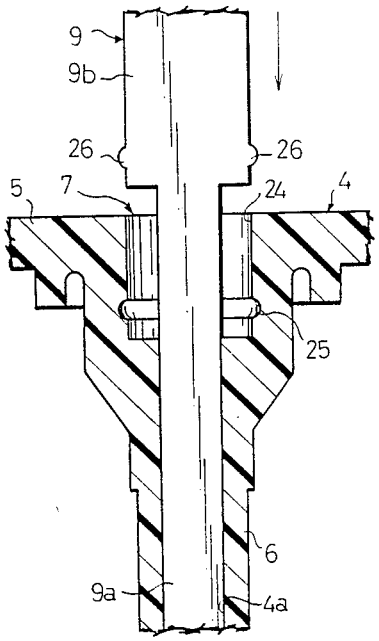
FIGS. 8 to 10 are partially vertical sectional views showing modifications of a case main body and a base plate, respectively.

On the lower part of the detective portion 9*a* of the printed board 9, an oblong reed switch 11 having a normally open contact is attached as a switch member. As shown in FIGS. 8 and 4, an accommodation hole 17 with a little larger oblong shape than the shape of the reed switch 11 is formed through the detective portion 9*a* at a position corresponding to the reed switch 11. Substantially a half of the reed switch 11 is accommodated in the accommodation hole 17 from the front side (left side of FIG. 4) of the printed board 9. In that state, extreme ends of the lower and upper end terminals 11*a* are bent respectively at substantially right angles, fitted into through holes 18 board adjacent to the upper and lower parts of the accommodation hole 17, and then secured by solder 21 from the rear side of the printed board 9. Accordingly, substantially a half of the reed switch 11 and a part of its terminals 11*a* are exposed from the front side of the printed board 9.

Further, as shown in FIG. 2, two pieces of connecting terminals 13 are formed projectinglY on the upper pair of the printed board 9 and adapted to be connected with a connector 12 extending from the vehicle body. The two connecting terminals 13 are electrically and respectively connected with the terminals 11*a* of the reed switch 11 through a printed Wiring 14 disposed on the printed board 9.

As shown in FIG. 1, a ring-shaped float 15 is fitted around an outside of the tubular member 6 so as to move upward and downward following upward and downward movements of the liquid level 3*a* of the brake oil 3. On an upper inner surface of the float 15, a magnet 16 is attached as a driving member. When the liquid surface 3*a* lowers to a level where the magnet 16 of the float 15 is opposite to the reed switch 11, the reed switch 11 is turned on.

On the lower end of the tubular member 6, a holding member 19 is secured through a fitting member 20 so as to prevent the float 15 from dropping out of the tubular member 6 and to hold the reed switch 11 "ON" regulating the magnet 16 from dropping below a predetermined level.

Next, the operation and effects of the liquid level sensor constituted as mentioned above will be explained.

As shown in FIG. 1, when there is a specified volume of the brake oil 3 stored within the reservoir tank 1, the liquid surface 3*a* is positioned above the reed switch 11, therefore, the reed switch 11 is in the state of "OFF".

Thereafter, due to use over years, the liquid surface 3*a* lowers to the level shown by the two dot chain line in FIG. 1 where the float 15 is in opposition to the reed switch 11. By virtue of magnetic force of the magnet 16 attached to the float 15, the reed switch 11 is turned "ON", lighting a warning lamp provided on an instrument panel of a vehicle (not shown). Therefore, a driver can find the brake oil 3 decreased.

Figure 21:
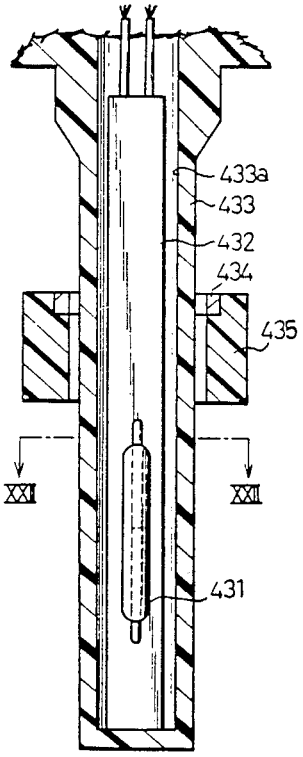
FIG. 21 (PRIOR ART)
FIG. 21 is a partially vertical sectional view showing a liquid level sensor of the related art.
Figure 22:
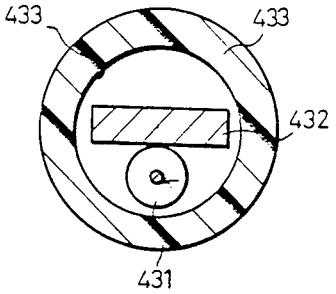
FIG. 22 (PRIOR ART)
FIG. 22 is a sectional view taken along the line XXII—XXII of FIG. 21.
Figure 23:
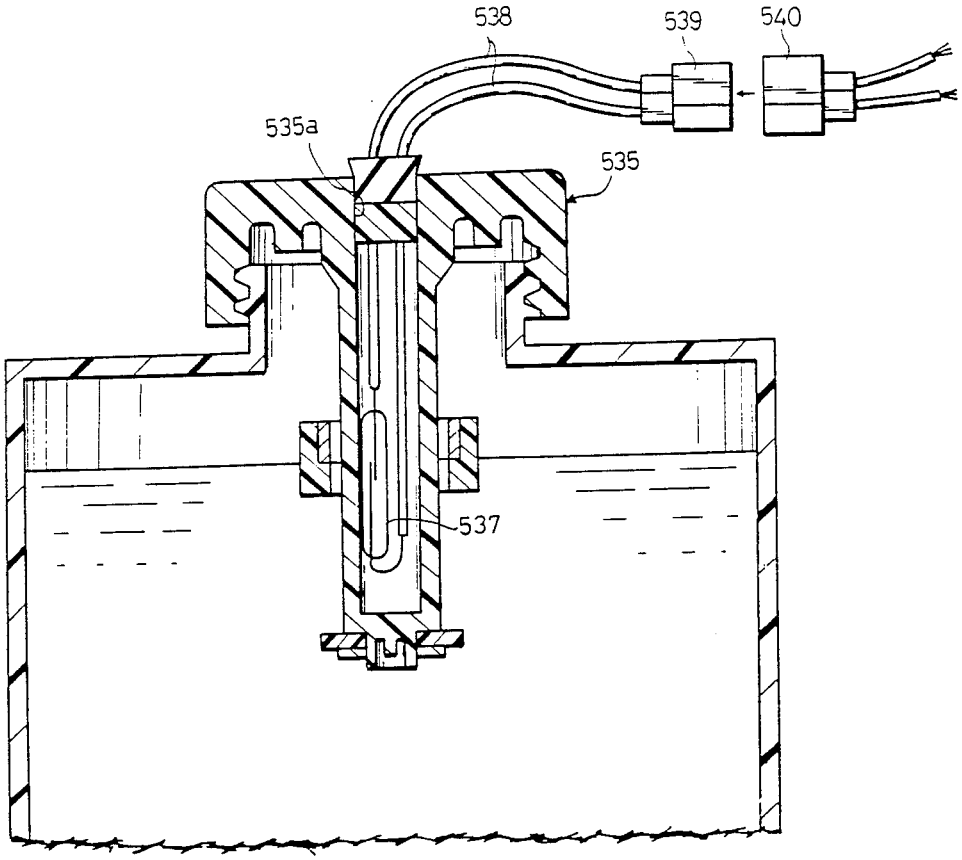
FIG. 23 (PRIOR ART)
FIG. 23 is a partially vertical sectional view showing another liquid level sensor of related art.

Further, since the width of the detective portion 9*a* of the printed board 9 is formed the same as the diameter of the fitting hole 7, the side surfaces of the detective portion 9*a* are in close-contact with the inner surface 4*a* of the tubular case 4. Therefore, the printed board 9 is rigidly supported and secured within the tubular case 4, and caused to be immovable horizontally, especially in the Widthwise direction. Accordingly, different from the liquid level sensor of the type which the base plate 432 is not secured to within the tubular case 433 as shown in FIGS. 21 and 22, the printed board 9 is restrained from vibrating at its own frequency within the tubular case 4 due to vibration, shock and the like while driving the vehicle. Consequently, there is no fear of erroneous function of the reed switch 11 or any damage caused by striking against the inner surface 4*a* of the tubular case 4.

In this embodiment, since the accommodation hole 17 is formed through the detective portion 9*a* of the printed board g so as to accommodate substantially a half of the reed sWitch 11, the part exposed from the detective portion 9*a* is smaller compared with the case in which such an accommodation hole 17 is not formed. Accordingly, the width of the detective portion 9*a* in relation to the fitting hole 7 of the tubular case 4 is not limited by the reed switch 11 but can be made equal to the diameter of the fitting hole 7. Moreover, since the space between the reed switch 11 and the inner surface 4*a* of the tubular case 4 becomes large, it is possible to insert the printed board 9 with the reed switch attached in the fitting hole 7 even when the diameter of the fitting hole 7 of the tubular case 4 is small. Namely, the case 4 can be made small.

Further, since retaining portions are defined by the side surfaces of the detective portion 9*a*, the printed board 9 can be secured to the tubular member 6 without any need for a separate member such as a sponge-like elastic material or the like. Accordingly different from the liquid level sensor of the type in which the reed switch is wound by the sponge like elastic material together with the base plate, the assembly work is easier and the number of parts constituting the liquid level sensor does not increase, which is favorable from the point of production cost.

(Second Embodiment)

Figure 5:
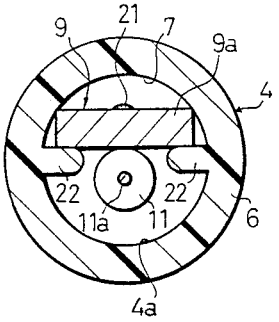
FIG. 5 is a horizontal sectional view showing a reed switch and adjacent part in a case main body of a second embodiment.

As shown in FIG. 5, in a second embodiment two guide members 22 are projectingly formed as retaining members so as to extend to the lower end of the tubular member 6 at symmetric positions on the inner surface 4*a* of the tubular case 4, which is different from the first embodiment. In this case, the width of the detective portion 9*a* of the printed board is formed a little smaller than the diameter of the fitting hole 7.

Accordingly, the second embodiment has the same function and effect as the first embodiment. Further, the printed board 9 can be inserted and fitted in the tubular case 4 by sliding the both end surfaces of the detective portion 9*a* along the guide member 22. Therefore, it is possible to support and fix the printed board 9 not only in the widthwise direction but also in the thickness direction by the guide members 22 and the inner surface 4*a* of the tubular case 4. In the second embodiment, the accommodation hole 17 for the reed switch 11 in the first embodiment can be omitted.

This embodiment may be modified and concretized, for example, as follows.

Figure 6:
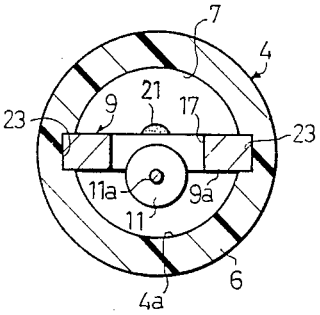
FIG. 6 is a horizontal sectional view showing a modification of a retaining portion.

(1) As shown in FIG. 6, two retaining grooves 23 may be formed as retaining portions at symmetric positions of the inner surface 4a of the tubular case 4 so as to extend toward the lower end of the tubular member 6.

In this structure, similar function and effect to those of the above-described second embodiment are obtained.

Figure 7:
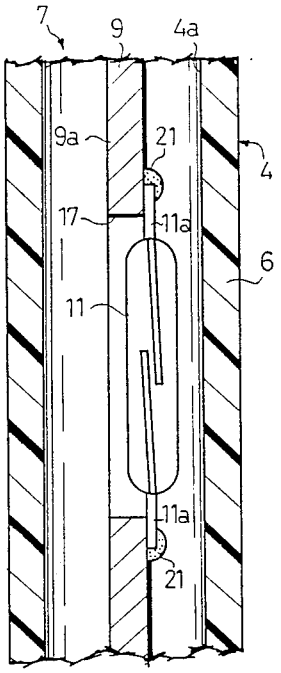
FIG. 7 is a partially vertical sectional view showing a modification of mounting of a reed switch.

(2) In the above described first embodiment, distal ends of the terminals 11*a* of the reed switch 11 are bent so as to fit in the through holes 18 formed on the printed board 9. However, as shown in FIG. 7, the terminals 11*a* of the reed switch Il may be fixed by solder 21 on the printed board 9 without bending after the reed switch 11 is disposed at the reed side of the printed board 9.

(3) Instead of the keyways 8 of the fitting hole 7 in the first embodiment, a large diameter hole 24 as a receiving portion having a larger diameter than the diameter of the fitting hole 7 may be bored as shown in FIG. 8 at the upper part of the tubular case 4, an annular groove 25 may be formed at the lower end, and an engagement projection 26 be formed so as to engage with the annular groove 25 on both sides of the lower end of the connecting portion 9*b* of the printed board 9.

Figure 10:
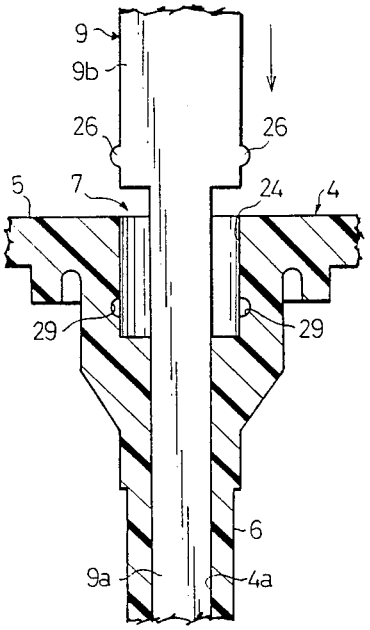
Figure 9:
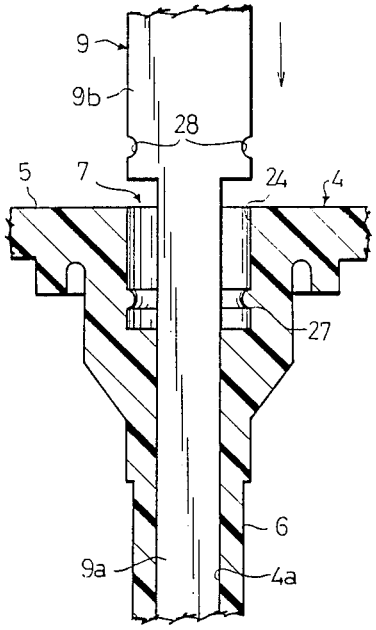

As shown in FIG. 9, an annular projection 27 may be formed at the lower end of the large diameter hole 24 and a semicircular engagement recess may 28 be formed on both sides of the lower end of the connecting portion 9*b* so as to engage with the annular projection 27. Instead of the annular groove 25, as shown in FIG. 10, a pair of semicircular recesses 29 may be formed at symmetric positionw of the lower end of the large diameter hole 24.

(4) In the above described two embodiments, the printed board 9 with the connecting terminals 13 projectingly formed is used as a base plate, but a printed board in which a lead wire is led out therefrom and a connecting terminal is connected at the distal end of the lead wire may be used.

(Third Embodiment)

A third embodiment of the present invention will be hereunder described With reference to FIGS. 11 and 12. This embodiment is different from the first embodiment mainly in a construction of a printed board and a connector.

Figure 12:
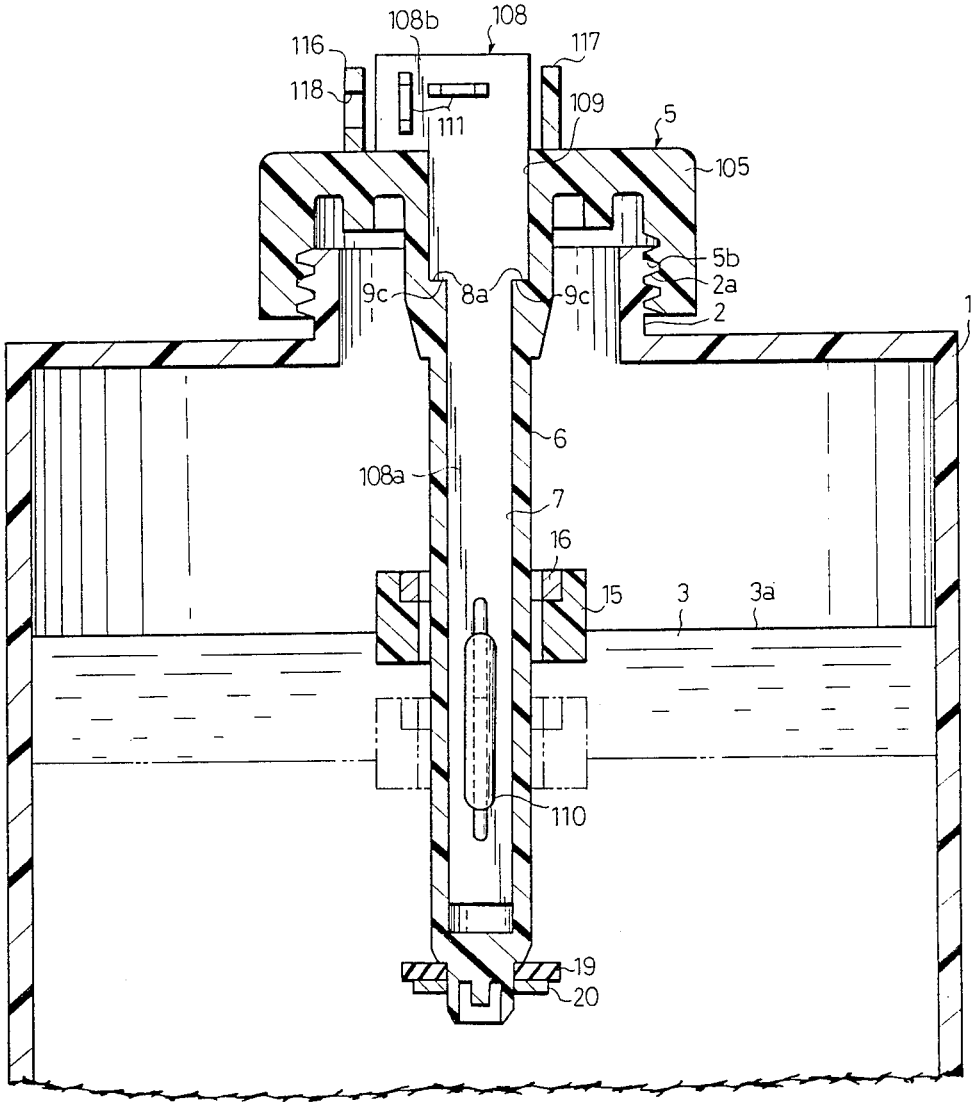

As shown in FIG. 12, a stepped portion is formed on the upper part of a connecting portion 108*b* of a printed board 108 to engage with the upper surface of a cover member 105.

It the lower part of a detective portion 108*a* of the printed board 108, a reed switch 110 having a normally open contact is filed as a switch member. On the connecting portion 108*b* of the printed board 108, two pieces of connecting terminals 111 are protruded and electrically connected with the reed switch 110 via printed wiring (not shown) formed on the printed board 108.

Figure 11:
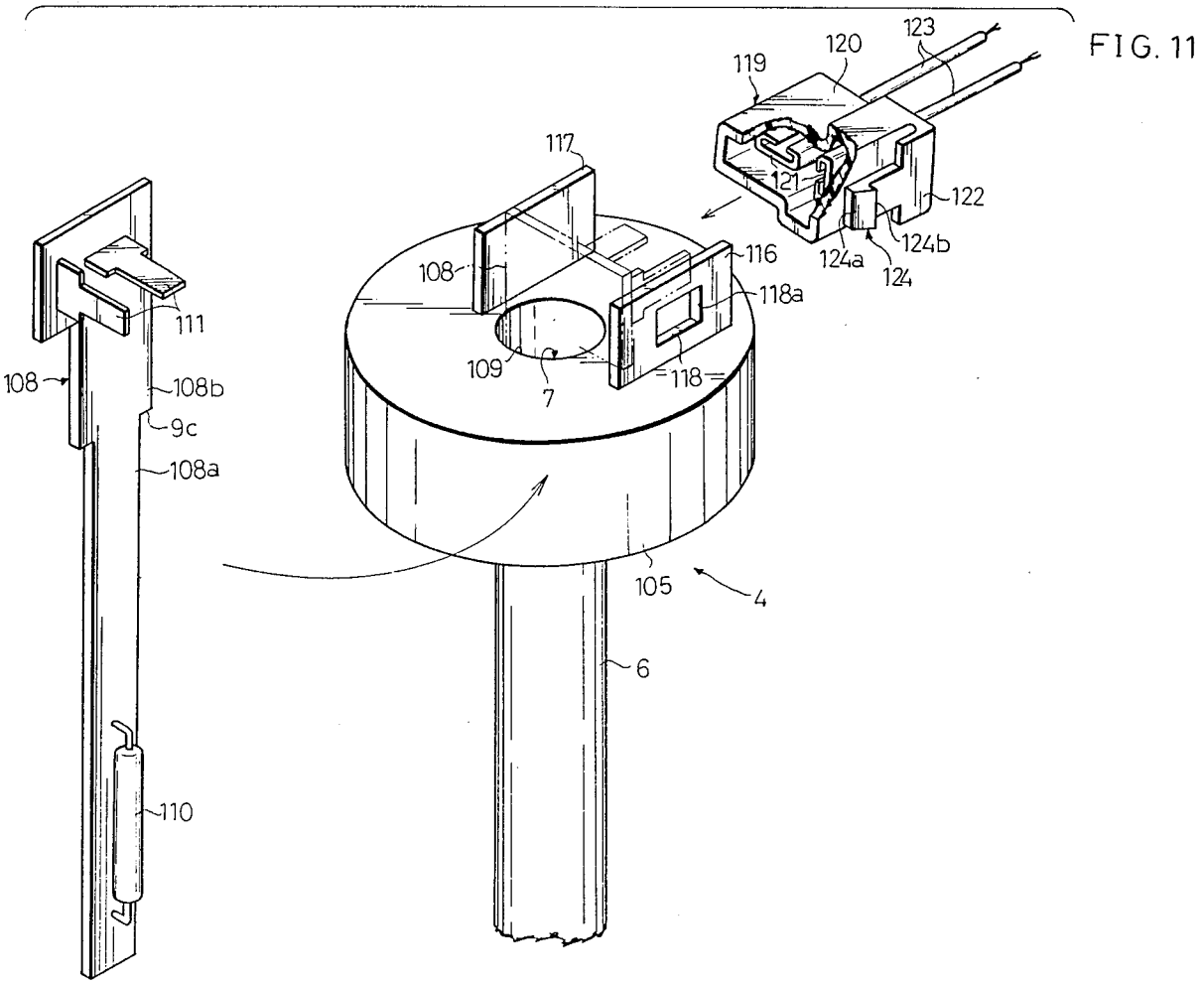
FIGS. 11 and 12 show a third embodiment.

As shown in FIG. 11, a pair of oblong plane-shaped connector guide members 116 and 117 are protruded in parallel adjacent to and on both sides of an opening 10*g* of the upper surface of the cover member 105. On the one connector guide member 116, a retaining hole 118 is formed to retain a connector 119.

The connector 119 to be secured between the two connector guide members 116 and 117 comprises a connector case 120 which opens at the front side (left side of FIG. 11) and a retaining piece 122 which is formed integrally With the rear end of one side of the connection case 20 and extends forward of the connector 119. Between the connector case 120 and retaining piece !22, a clearance is formed to allow the retaining piece 122 to bend. On the distal end of the outside surface of the retaining piece 122, a retaining portion 124 is protruded to engage with the retaining hole 118 of the connector guide member 116. The side surface of the retaining portion 124 constitutes a tapered surface 124*a* rising toward the rear side of the connector 119 while the rear surface constitutes a retaining surface 124*b* toengage with the rear side wall 118of the retaining hole 118. Inside the connector case 120, two pieces of connection fittings 121 are disposed at the positions corresponding to the connecting terminals 111 of the printed board 108, and connected withlead wires 123 led in from the vehicle body.

The arrangement of the othermembers is the same as that of the first embodiment and the explanation will be omitted by fixing the same reference number to the corresponding members.

Next, the operation and effects of the liquid level sensor arranged as above will be explained.

In the process of installing the Iiquid level sensor on the vehicle, on connecting the connector 119 of the vehicle body side with the connecting terminals 111 of the printed board 108, as shown in FIG. 11, the connector 119 is held first with one hand so that the retaining piece 122 corresponds to the connector guide member 116 with the retaining hole 118 formed. Making the front end of one side of the connector 119 abut against the rear end of the inside of the connector guide member 117 while the front end of the retaining piece 122 against the rear end of the connector guide member 116, the connector 119 is pushed toward the opening 109. Then, the connector 119 moves along the inner surfaces of the connector guide members 116 and 117. The retaining piece 122 bends by its own elasticity toward the connector case 120.

When the connector 119 moves to a predetermined connecting position, the connection fittings 121 of the connector case 120 are fitted outwardly to the connecting terminals 111 of the printed board 108 while the retaining portion 124 of the retaining piece 122 is fitted into the retaining hole 118 of the connector guide member 116. In this state, since the retaining surface 124*b* of the retaining member 116 abuts against the rear side wall 118*a* of the retaining hole 118, the connector 119 can be reliably secured without getting out of the connector guide members 6 and 117.

As described above, the liquid level sensor of this embodiment enables the connector 119 to be connected reliably with the connecting terminals 111 with one hand. Accordingly, the connecting work is easy, different from the liquid level sensor of the related art. Further, since the reed switch 110 is disposed on the printed board 108, no lead wire for connection with the reed switch 110 is required and there is no case of damaging the lead wire during the connecting work. Moreover, troublesome cutting work of the lead wire can be omitted soldering work may be simplified and consequently, the production cost of the liquid level sensor may be reduced.

The third embodiment may be modified as below.

Figure 13:
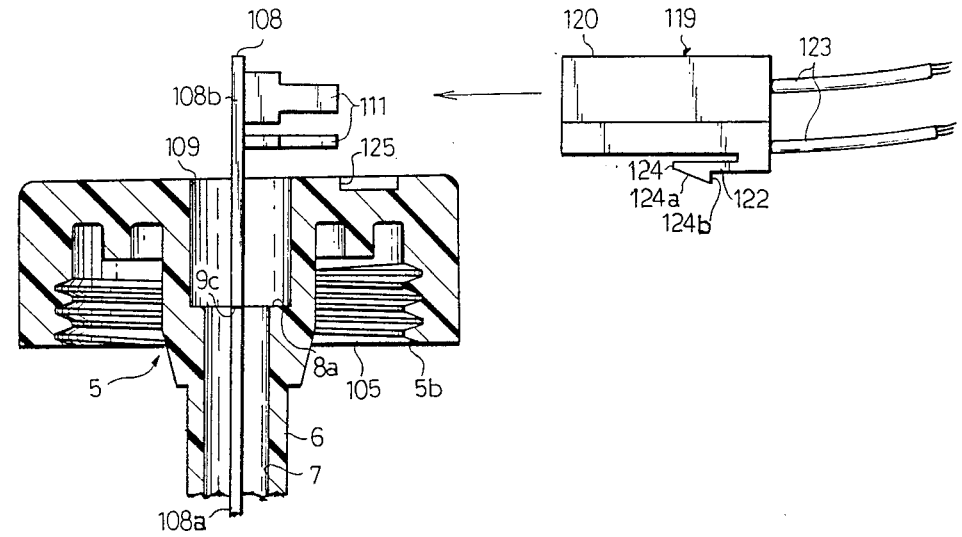
FIG. 13 is a partially vertical sectional view shoWing a modification of a connector guide portion.

As shown in FIG. 13, a retaining recess 125 is formed adjacent to the opening 109 on the upper surface of the cover member 105 so as to define a connector guide member by the upper surface of the cover 105 and the retaining recess 125. In this case, the connector guide members 116 and 117 in the above embodiment can be omitted.

(Fourth Embodiment)

Next, a fourth embodiment of the present invention will be described with reference to FIGS. 14 to 18. This embodiment is different from the first and second embodiments mainly in the structure of the printed board.

A printed board 208 comprises a detective portion 208*a*, and a connecting portion 208*b* integrally formed at the upper part of the detective portion 208*a* and projecting upwardly from an opening 209 of a case 204. A rubber plug 210 is disposed on the upper end of the detective portion 208*a* while inserted in the opening 209.

Stepped portions 208*c* are defined at the upper parts of both side edges of the detective portion 208*a* and retained on a stepped portion 207*a* defined at the upper part of a fitting hole 207. Engagement recesses 211 are defined at a lower position below the rubber plug 210 on both of the upper sides of the detective portion 208*a* and are retained on an engagement projection 212 provided on the upper part of the fitting hole 207.

Figure 15:
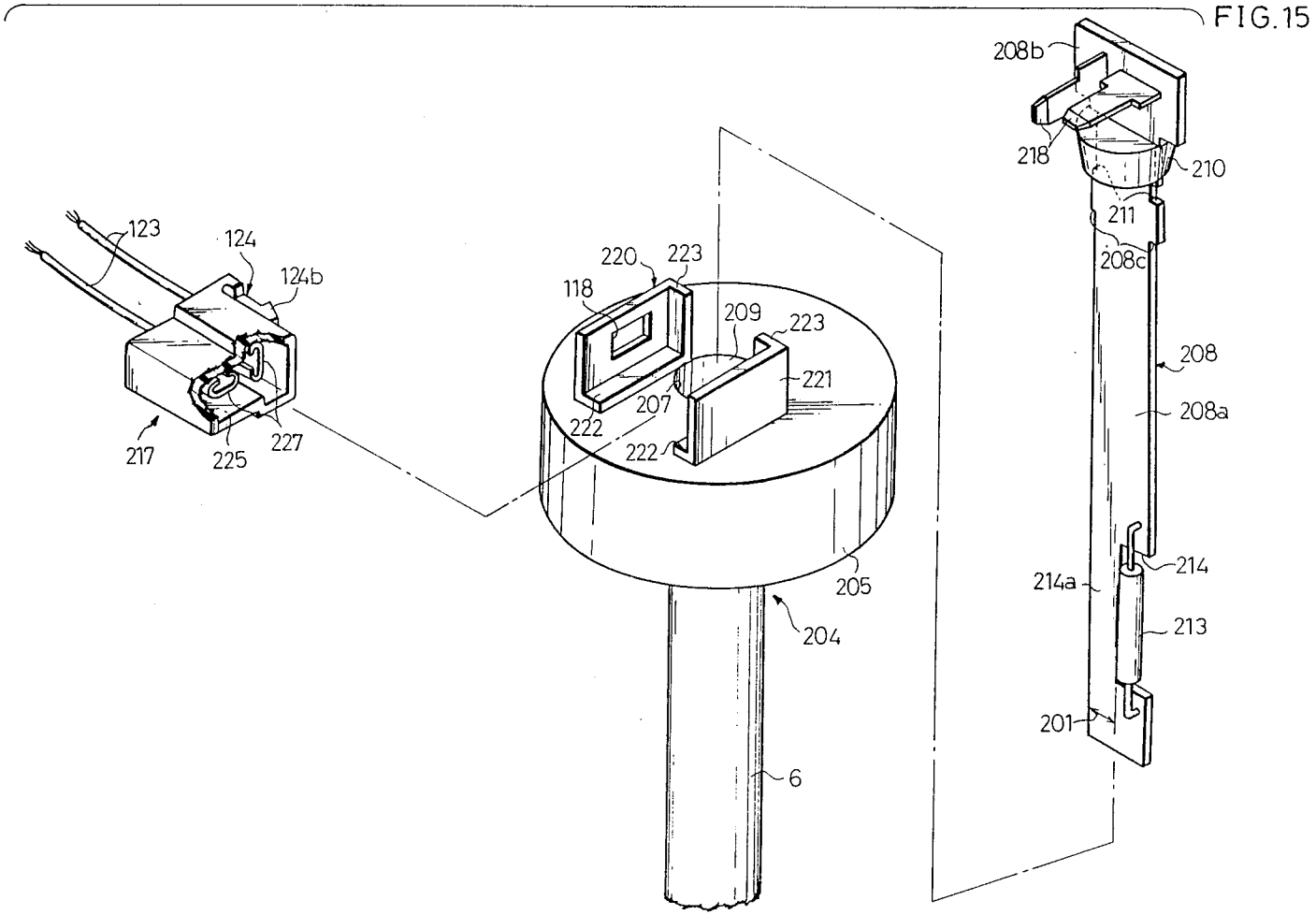
Figure 16:
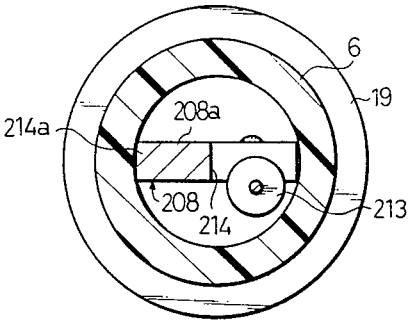
Figure 17:
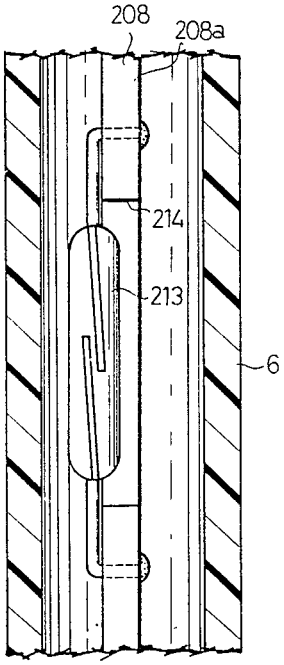

As shown in FIGS. 15 to 17, an accommodation hole 214, which is a little larger than a contour of a reed switch 213, is defined by cutting at one side in the widthwise direction on the lower part of the detective portion 208*a* so as to extend in the longitudinal direction of the detective portion 208*a*. The reed switch 213 is attached to the accommodation hole 214 in the same manner as the first embodiment is shown in FIG. 18, a side portion 214 having a width 201 is formed at the other side in the widthwise direction on the lower part of the detective portion 208*a*.

Figure 14:
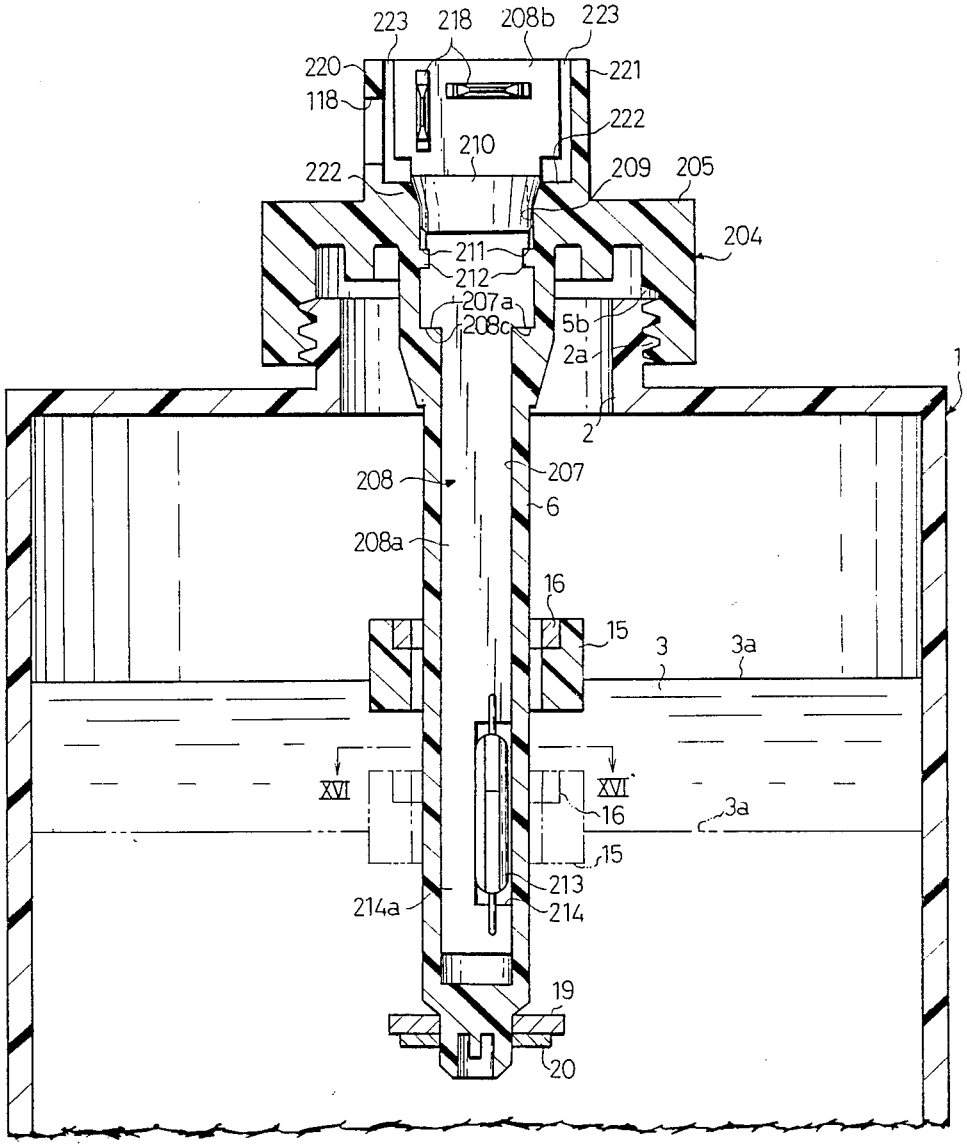
FIGS. 14 to 18 show a fourth embodiment.

As shown in FIG. 14, a pair of connector guide members 220 and 22*i*, which are similar to the connector guide members 116 and 117 of the second embodiment, are formed on the upper surface of a cover member 205. The lower end and rear end of each connector guide member 220, 221 are bent to the opposing direction to each other so as to define guide portions 222 and regulating portions 223, respectively. A connector 217 like the connector 119 of the second embodiment is adapted to be attached to between both the connector guide members 220 and 221 so that a connection fitting 227 in a connector case 225 is connected with connecting terminals 218 of the connecting portion 208*a* of the printed board 208.

The operation and effects of the liquid level sensor arranged as above Will be explained.

Figure 18:
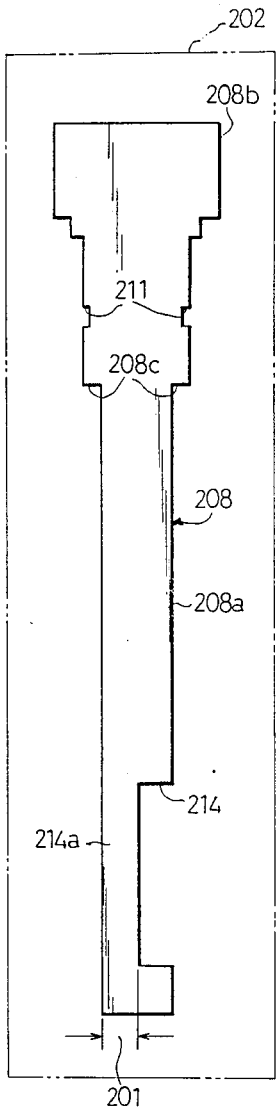

When forming the printed board 208 in a manufacturing process of the liquid level sensor, as shown in FIG. 18, a material board 202 is punched out into the same form as the outline of the printed board 208. In the present embodiment, the accommodation hole 214, which is defined at the one side in the widthwise direction of the printed board 208, is formed at the same time as the punching. Therefore, a punching step for forming the accommodation hole 214 can be omitted With a resultant reduction in production cost, as compared with the case in which an accommodation hole is defined at the center in the widthwise direction of a printed board. Moreover, the side portion 214*a* having the width 201 of the printed board 208 has enough strength to prevent a cracking, snapping or other damages thereof.

When inserting the connector 217 into between the connector guide members 220 and 221, the bottom surface of the connector case 205 slides along the guide portions 222 of the guide members 220 and 221 enabling a smooth insertion of the connector 217. The front end of the connector case 225 abuts against the regulating portions 223 of the connector guide members 220 and 221 to regulate the movement of the connector 217, then the connection fittings 227 are connected to the connecting terminals 218. At the same time, the connector 217 is sandwiched by the guide portions 222 and regulating portions 223, thereby preventing the connector 217 from shaking or vibrating in the longitudinal or lateral direction thereof.

Further, the present invention is not necessarily limited to the arrangements of the embodiments described above, and may be modified and carried out, for example, in the following various forms.

(1) In the embodiments described above, the liquid level sensor is concretized in the reservoir tank 1 of the vehicle brake oil but it can be embodied in a reservoir tank of power, steering oil, a fuel tank or other auto reservoirs. Further, the liquid level sensor can be materialized in use besides the vehicle, for example, in a water reservoir, a medicine tank or other reservoir.

Figure 19:
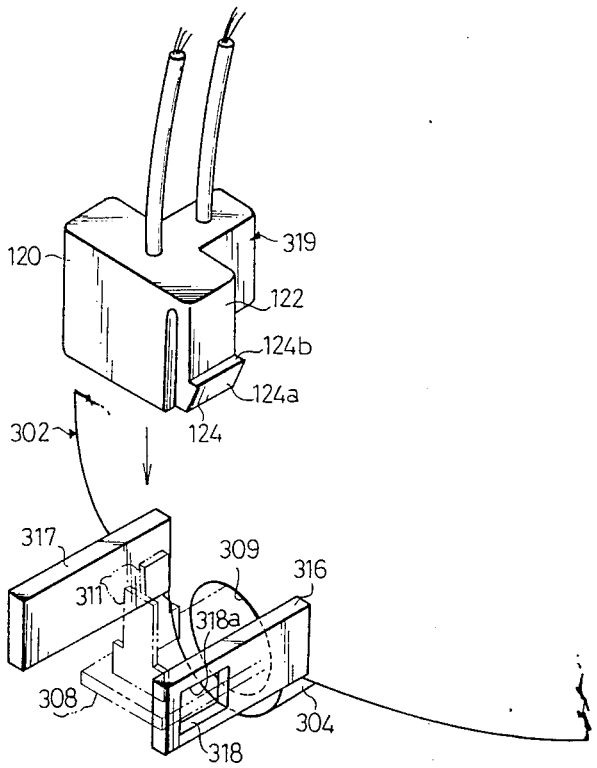
FIG. 19 is a partially exploded perspective view showing a modification of a liquid level sensor.
Figure 20:
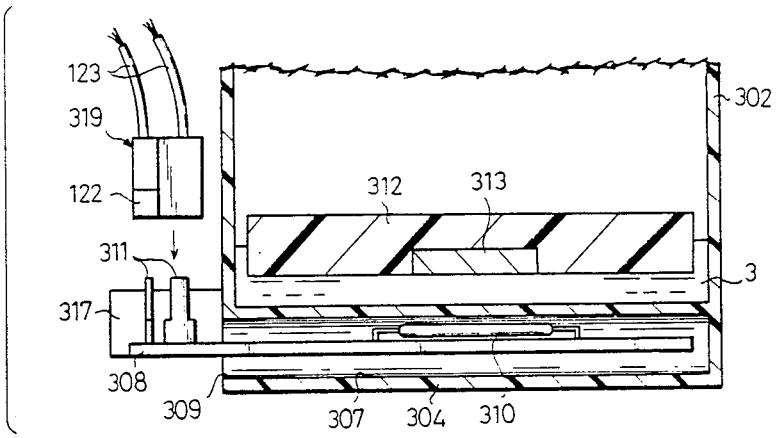
FIG. 20 is a partially vertical sectional view showing the same.

(2) In the embodiments described above, the liquid level sensor is concretized in a type which is installed on the reservoir tank from the upper surface thereof, but, as shown in FIGS. 19 and 20, it may be installed from the side of the lower end o: a reservoir tank 302. Namely, a pair of connector guide members 316 and 317 are protruded in parallel with each other at a position adjacent to an opening 309 of a fitting hole 307 provided horizontally at the lower end of a case 304 of the reservoir tank 302. The connector 319 is guIded between the connection guIde members 316 and 317, so as to be connected wi&h connecting terminals 311 disposed on a printed board 308. A float 312 provided With a magnet 313 at the lower end portion floats on the brake oil 3 in the reservoir tank 302 and when the brake oil 3 decreases, the float 312 lowers and activates a reed switch 310.

(3) The fitting hole 7, 207 or 307 to be bored in the tubular case 4, 204 or 304 is not limited to the circular shape but can be concretized in an oval shape in plan view.

Since it is apparent that a wide variety of different embodiments may be arranged Without departing from the spirit and scope of the present invention, it should be noted here that the present invention is not necessarily limited to the specific embodiments but limited solely by the appended claims.

What is claimed is:

1. A liquid level sensor, comprising:

a tubular case having an inner surface;

a base plate disposed in an interior of said case extending in a longitudinal direction thereof, and having a wiring;

a switch member provided on said base plate and electrically connected with said wiring;

a float disposed on an exterior of said case and movable in accordance with a displacement of a liquid level of a liquid stored in a reservoir tank;

a driving member provided on said float and driving said switch member;

first retaining means provided on said base plate;

second retaining means provided on said inner surface of said case and engaging with said first retaining means so that said base plate is fixed at a predetermined position within said interior of said case, wherein said inner surface of said case has a substantially circular section, said first retaining means includes a pair of said surfaces of said base plate, said pair of side surfaces has substantially the same width as a diameter of said inner surface and they come in contact with said inner surface.

2. The liquid level sensor as defined in claim 1, wherein said base plate has an accommodation hole, said switch member being partially mounted in said accommodation hole.

3. The liquid level sensor as defined in claim 1, wherein said base plate includes a printed board on which said wiring is printed.

4. The liquid level sensor as defined in claim 1, wherein said base plate includes a first portion having a pair of side surfaces and a second portion extending longitudinally of said base plate from one end of said first portion, said case having a receiving portion receiving said second portion, said second retaining means supporting said second portion in said receiving portion.

5. The liquid level sensor as defined in claim 4, wherein said second portion has a larger width than that of said first portion thereby having a stepped portion at a joint portion with said first portion, said case has an open end portion for inserting said base plate and a pair of keyways are formed at said open end as said second retaining means for retaining both side surfaces in a width wise direction of said second portion, said key ways having engagement portions which support said stepped portion of said second portion while engaging therewith.

6. The liquid level sensor as defined in claim 5, wherein a part of said second portion protrudes outwardly of said case, and connecting terminals are provided on a protruded part of said second portion so as to be connected with said switch member through said wiring.

7. The liquid level sensor as defined in claim 4, wherein said second portion has a pair of projections at positions opposing to each other on both side surfaces in a widthwise direction thereof, and said receiving portion has groove means extending in a circumferential direction thereof for receiving and holding said projections, said projections and said groove means constituting said second retaining means.

8. The liquid level sensor as defined in claim 4, wherein said second portion has a pair of projections disposed opposite each other in a perpendicular direction to said second portion, and said receiving portion has a pair of recesses at positions corresponding to said projections and receiving and holding said recesses, said projections and said recesses constituting said second retaining means.

9. The liquid level sensor as defined in claim 4, wherein said second portion has a pair of recesses disposed opposite each other in a perpendicular direction to said second portion, and said receiving portion has projections extending in a circumferential direction thereof and engaging with said recesses, said recesses and said projections constituting said second retaining means.

10. A liquid level sensor, comprising:

a tubular case having an inner surface;

a base plate disposed in an interior of said case extending in a longitudinal direction thereof, and having a wiring;

a switch member provided on said base plate and electrically connected with said wiring;

a float disposed on an exterior of said case and movable in accordance with a displacement of a liquid level of a liquid stored in a reservoir tank;

a driving member provided on said float and driving said switch member;

first retaining means provided on said base plate;

second retaining means provided on said inner surface of said case and engaging with said first retaining means so that said base plate is fixed at a predetermined position within said interior of said case, wherein said base plate includes a pair of side surfaces, said retaining means includes a pair of projections protruding inwardly from said inner surface of said case, extending in said longitudinal direction of said case, and supporting both side surfaces in a widthwise direction of said case and supporting one side surface in a thickness direction of said case, both side surfaces in said widthwise direction being retained on the other side surface in said thickness direction of said base plate.

11. A liquid level sensor, comprising:

a tubular case having an inner surface;

a base plate disposed in an interior of said case extending in a longitudinal direction thereof, and having a wiring;

a switch member provided on said base plate and electrically connected with said wiring;

a float disposed on an exterior of said case and movable in accordance with a displacement of a liquid level of a liquid stored in a reservoir tank;

a driving member provided on said float and driving said switch member;

first retaining means provided on said base plate;

second retaining means provided on said inner surface of said case and engaging with said first retaining means so that said base plate is fixed at a predetermined position within said interior of said case, wherein said retaining means includes a pair of side surfaces, wherein said retaining means includes a pair of recesses formed on said inner surface of said case, extending in said longitudinal direction, and retaining both side surfaces in a widthwise direction of said case.

12. A liquid level sensor comprising:

a tubular case having an opening;

a base plate disposed in an interior of said case and having one end portion thereof protruding out of said opening;

a switch member provided in an interior of said case;

a connecting terminal electrically connected with said switch member, disposed on said base plate, and protruding outwardly from said opening of said case;

a float disposed on an exterior of said case and movable in accordance with a displacement of a liquid surface of a liquid stored in a reservoir;

an external connector;

a driving member provided on said float and driving said switch member; and securing means, disposed adjacent to said opening of said case, for securing said external connector to said connecting terminal.

13. The liquid level sensor as defined in claim 12, wherein said switch member is disposed on said base plate.

14. The liquid level sensor as defined in claim 12, wherein said securing means includes a pair of spaced guide members each in the shape of a plate disposed opposite each other in a perpendicular direction to said protruded portion of said base plate.

15. The liquid level sensor as defined in claim 14, wherein one of said guide members has a hole securing said external connector between said two guide members by receiving and holding a retaining portion formed on said external connector.

16. The liquid level sensor as defined in claim 12, wherein said securing means comprising a recess defined on said case retaining a retaining portion formed on said external connector.

17. The liquid level sensor as defined in claim 12, wherein a portion of said case is provided on a vertically lower part than said liquid in said reservoir tank.

* * * * *